United States Patent [19]

Bergman

[11] Patent Number: 4,719,726

[45] Date of Patent: Jan. 19, 1988

[54] CONTINUOUS SPHERICAL TRUSS CONSTRUCTION

[76] Inventor: Helmut Bergman, 116 Newport Ave., Scarborough, Ontario M1L 1J5, Canada

[21] Appl. No.: 851,934

[22] Filed: Apr. 14, 1986

[51] Int. Cl.[4] ..... E04B 1/32

[52] U.S. Cl. ..... 52/81; 52/DIG. 10

[58] Field of Search ..... 52/81, DIG. 10

[56] References Cited

U.S. PATENT DOCUMENTS

| | | | |
|---|---|---|---|
| 2,986,241 | 5/1961 | Fuller | 52/641 X |
| 3,220,152 | 11/1965 | Sturm | 52/DIG. 10 X |
| 3,354,591 | 11/1967 | Fuller | 52/81 |
| 3,568,381 | 3/1971 | Hale | 52/81 |
| 3,611,620 | 10/1971 | Perry | 52/81 X |
| 3,645,833 | 2/1972 | Figge | 52/DIG. 10 X |
| 3,722,153 | 3/1973 | Baer | 52/81 |
| 3,746,345 | 7/1973 | Palazzolo | 52/DIG. 10 X |
| 3,749,636 | 7/1973 | Tranquillitsky | 52/DIG. 10 X |
| 3,953,948 | 5/1976 | Hogan | 52/81 |
| 4,020,205 | 4/1977 | Haselbauer | 52/DIG. 10 X |
| 4,096,479 | 6/1978 | Van Biskirk | 52/DIG. 10 X |
| 4,115,963 | 9/1978 | Lubov | 52/81 |
| 4,241,550 | 12/1980 | Sumner | 52/81 |
| 4,551,726 | 11/1985 | Berg | 52/81 X |

OTHER PUBLICATIONS

Zone Primer; Baer, Steve; 1970.

*Primary Examiner*—William F. Pate, III
*Assistant Examiner*—Creighton Smith

[57] ABSTRACT

My invention relates to a tetrahedral-octahedral truss construction system for shell framework of icosahedral-spherical, and/or part-spherical structures, which are based on the regular icosahedron. The system is represented by a central nucleus and by a sequentially ordered infinite set of ever-increasing, space-filling truss layer shells, which are constructed from triangular units of equal size, equal angular values and identical proportions. Icosahedral-spherical truss shells can be constructed of single, double and multiple layers.

7 Claims, 33 Drawing Figures

Fig.7
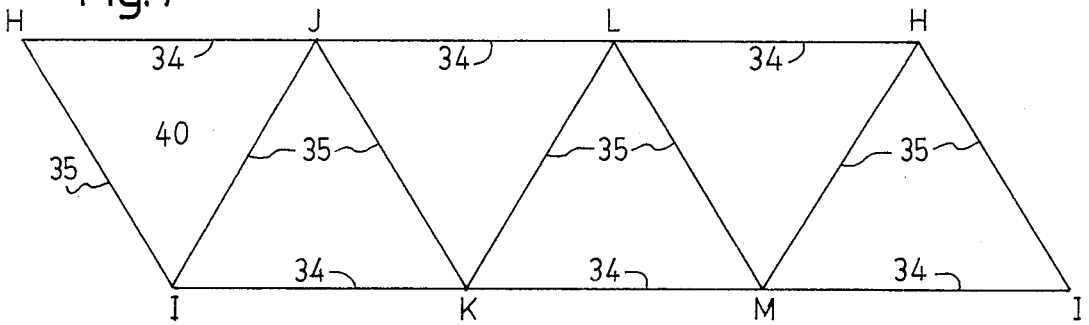
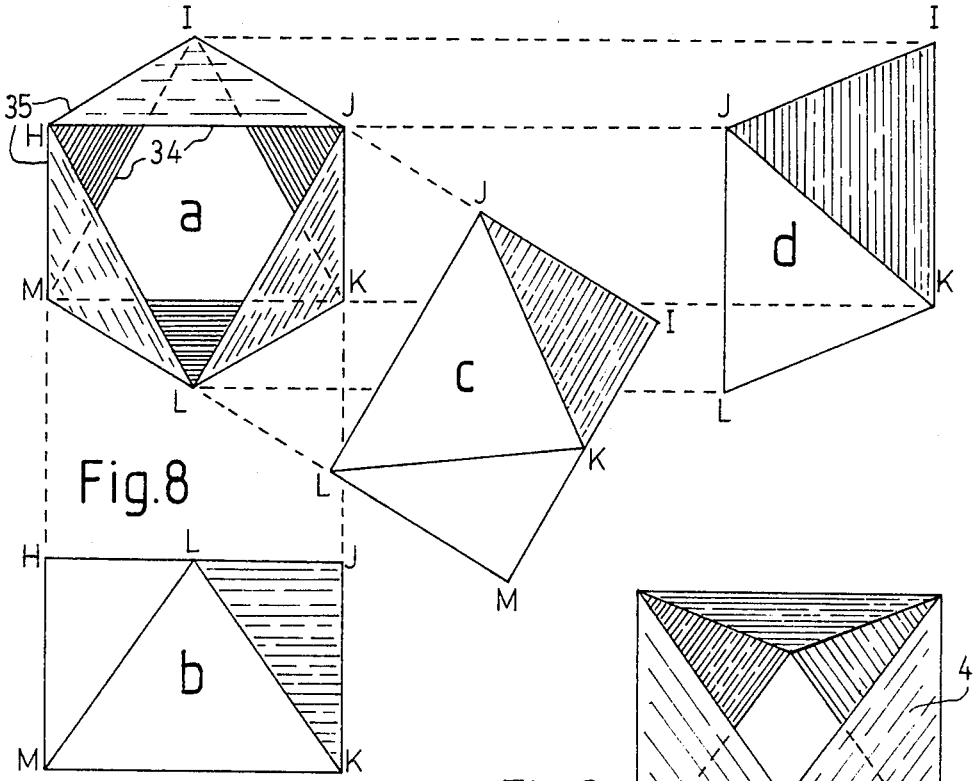
Fig.8
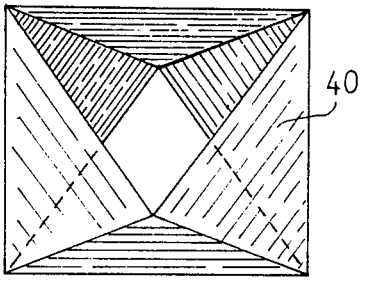
Fig.9
Fig.10
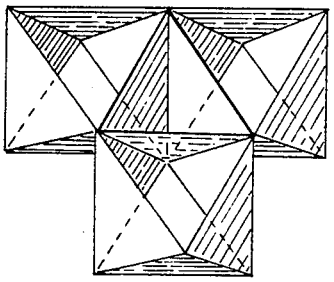
Fig.11
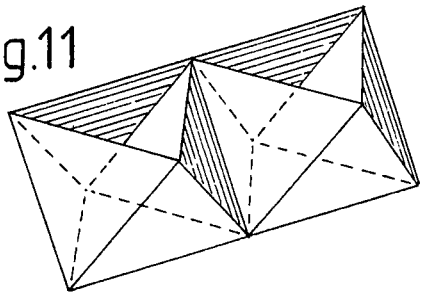

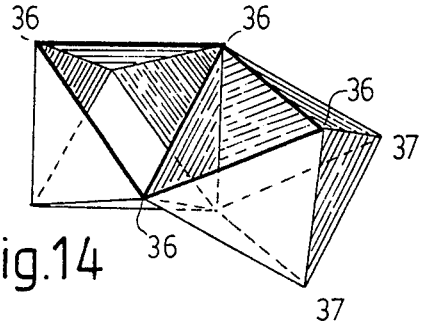
Fig.14
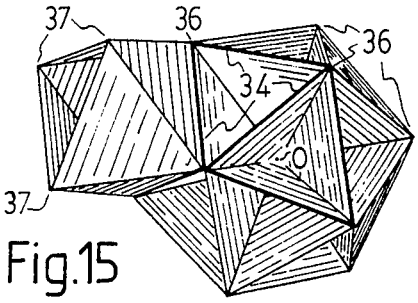
Fig.15
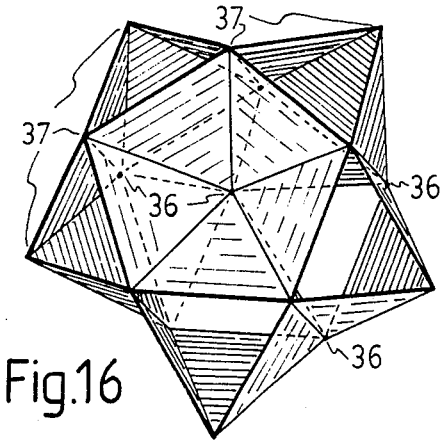
Fig.16
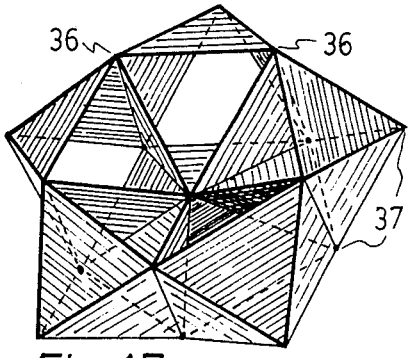
Fig.17
Fig.18
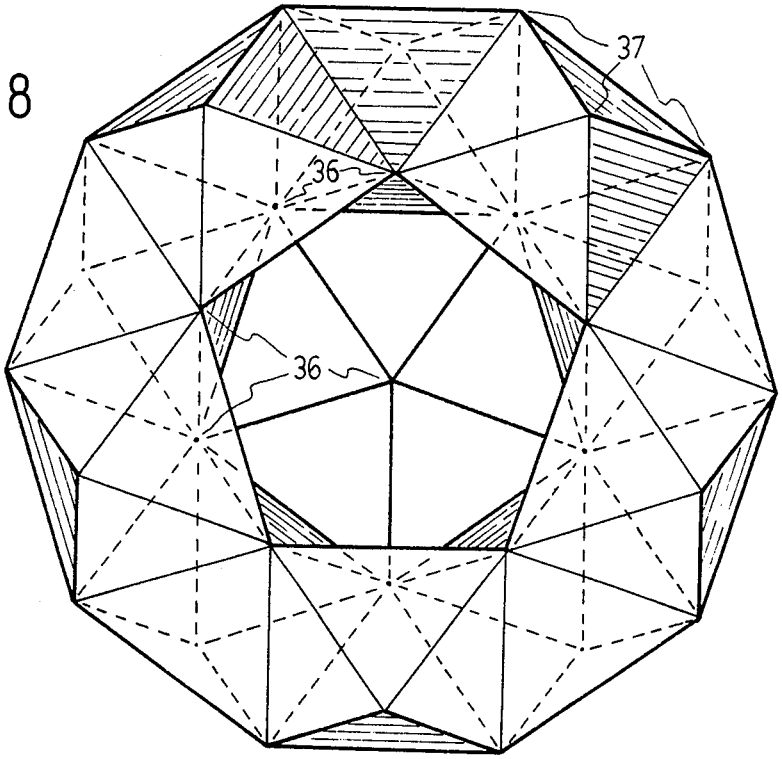

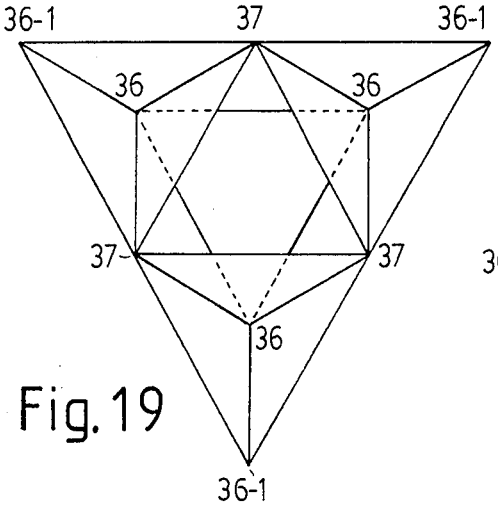
Fig. 19
Fig. 20
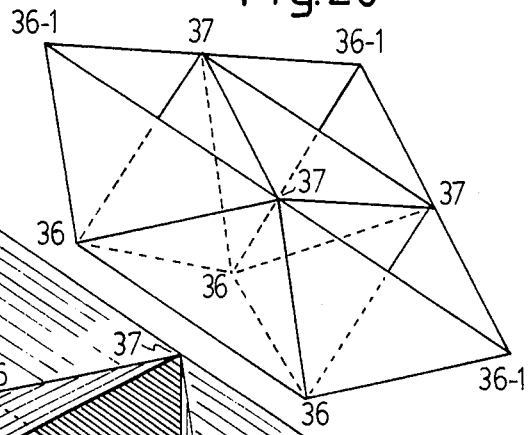
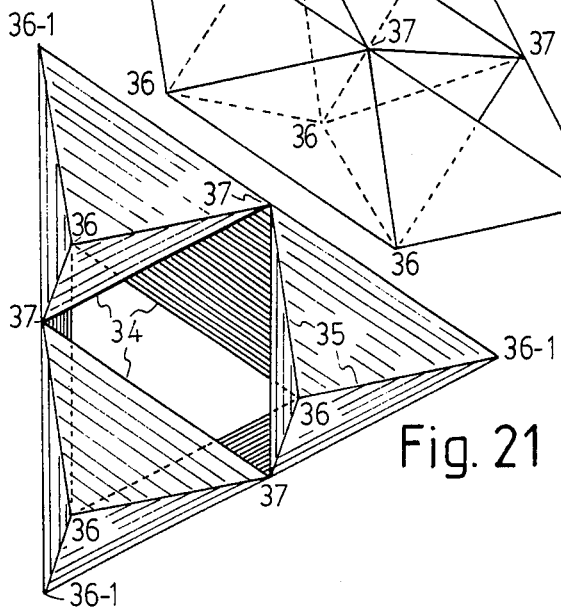
Fig. 21
Fig. 22
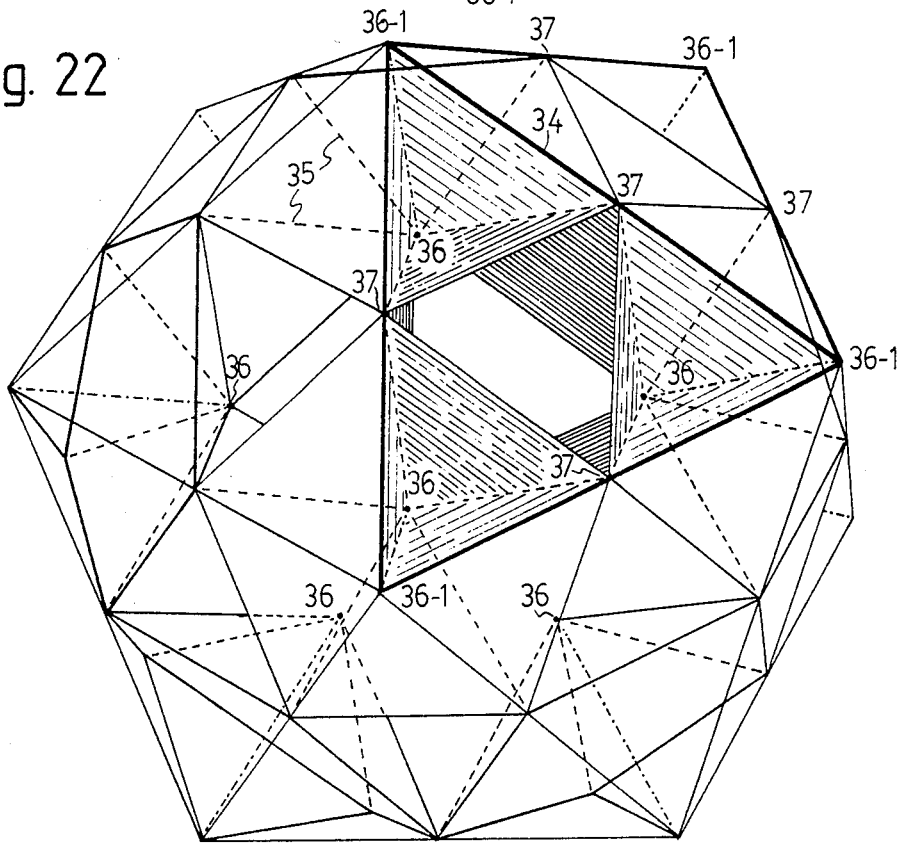

Fig. 31
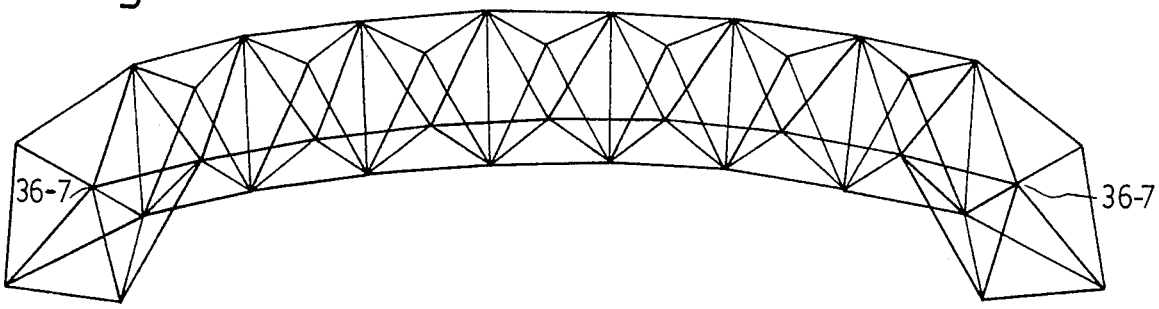
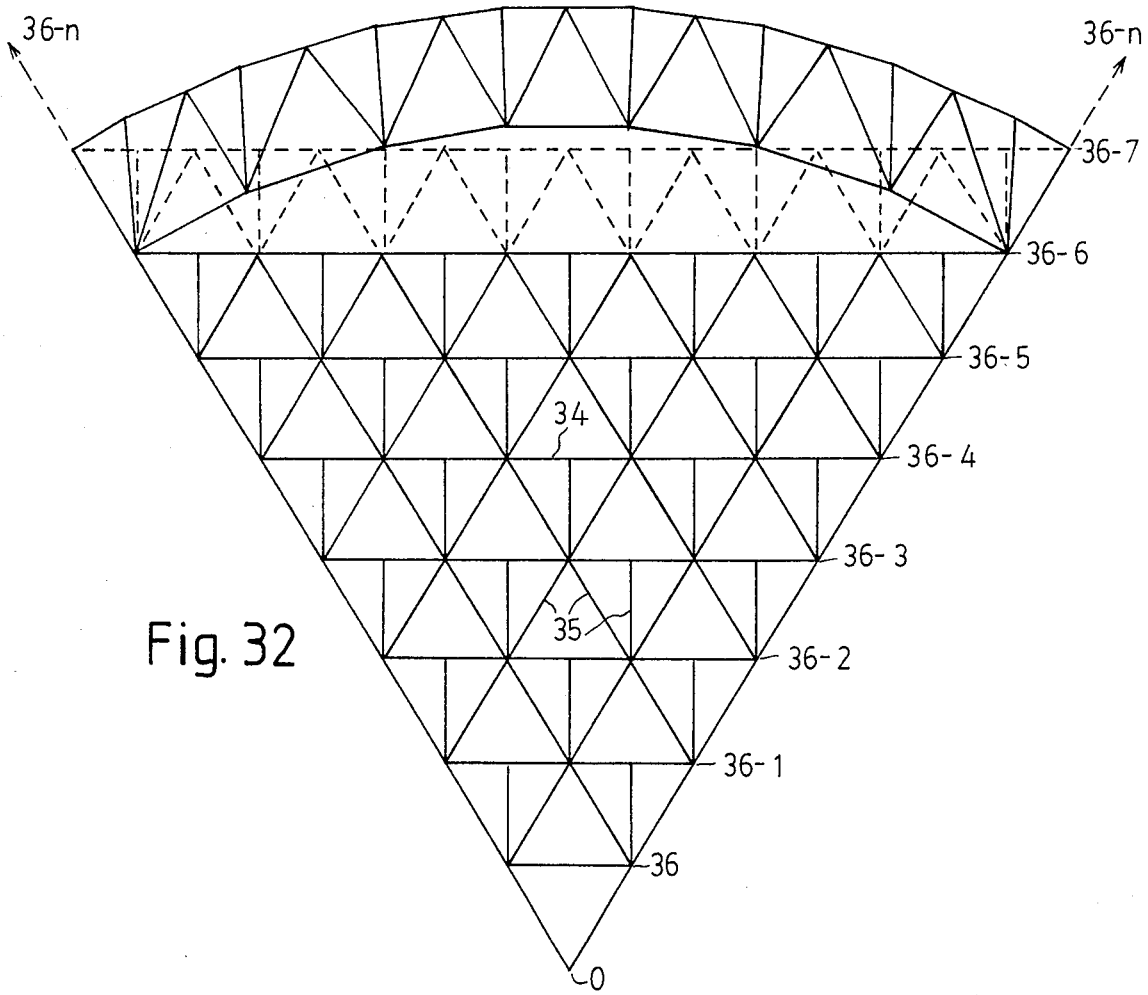
Fig. 32

CONTINUOUS SPHERICAL TRUSS CONSTRUCTION

BACKGROUND OF THE INVENTION

Structures built with trusses consisting of tetrahedrons and/or octahedrons have been in use for many years. They can be seen today in shopping malls and other buildings as roofing trusses, as dividing walls, as framework for the support of light fixtures, sprinkler systems, ceiling panels, advertising displays, etc. One of the most inspiring representative of such structures is the Olympic Stadium in Berlin, West Germany, which has a contilevered space frame roof structure of this kind, which was built by Unistrut Building Systems of Wayne, Mich., USA. A U.S. Pat. No. 2,986,241, issued to Mr. R. B. Fuller, provides a comprehensive description of octahedral-tetrahedral trusses. Emphasis is given to the highly favorable weight to strength ratio inherent to truss designs of this type. Mr. Fuller's patent prescribes the exclusive use of equilateral triangles with which a wide selection of structural trusses for wall, roof and floor designs, related to the rectangular prism rather than spherical space enclosures, can be built. Another patent, also issued to Mr. Fuller, U.S. Pat. No. 3,354,591, describes an octahedral tensegrity system, being a flexible truss. It was used for the construction of the United States Pavilion in Montreal, Quebec, Canada at "EXPO '67". The structure is geodesic of which octahedrons are connected to each other. Each octahedron is created by having its X, Y and Z axes represented by three rigid rods as compression members. The six rod ends are held in position by tension wires. The outer surface, according to the drawing for his patent, consists of small hexagonal and pentagonal pyramids which are separated by small recessed triangular panels. The Montreal structure had additional connecting rods between all pyramidal vertices installed. A substantial increase in structural strength was achieved with this addition, however, the result was also increased complexity and higher construction cost.

While studying geometric solids and constructing models, I discovered one type of isosceles triangle of specific angular values and proportions, which possesses extraordinary features: (a) It can be described as a "divine" or "golden" triangle, because the golden ratio is evident on its face many times, when lines are drawn from any of its three vertices across the triangle to intersect at right angles the line opposite of the vertex. The golden ratio is always found in the proportion of at least one part of the divided line to the line drawn; (b) In its plurality, this isosceles triangle, used in the assembly of tetrahedrons and octahedrons, which in turn are assembled into specific patterns—explained later in this text—produces three distinctly different forms of space filling and close-packing of geometric solids, which produces a simultaneous spherical supersymmetry. (c) The combination of the three forms of close-packing of the above mentioned octahedrons and tetrahedrons permits the construction of the framework of icosahedral-spherical space-enclosing super-structures with the exclusive use of the said isosceles triangle.

Close-packing features of geometric solids have fascinated scientists and mathematicians for millennia. One reason for this continued interest may be the need for simpler, lighter, stronger and less expensive construction methods for buildings and space enclosures of all kinds, involving less material while employing the least possible number of types of identical structural elements. My tetrahedral-octahedral truss design fulfills the aforesaid need on a broad scale, and it is especially suited for spherical and dome-like structures.

The three distinctly different types of close-packing of geometric solids are three-axial, six-axial and ten-axial. All three are present simultaneously in the truss system described in this invention.

Close-packing is the feature of some geometric solids such as cubes, tetrahedrons, octahedrons etc., which allows them, in their plurality either alone or in combination with others, to be attached to each other without leaving any space between them.

Three-axial pertains to the intersecting of three straight lines (axes) at one common point. This configuration can also be visualized as six lines (vectors) radiating outward from that one common point in space, in a specific symmetrical way.

Three-axial close-packing is the feature of certain polyhedrons, of which space-filling occurs outward in six distinctly different linear directions, as polyhedrons are added to the assembly. The type of polyhedron of the system described in this invention has six sides. The sides are congruent rhombi, and the polyhedron is a rhombic hexahedron, therefore, the close-packing feature is rhombic-hexahedral, however, each rhombic hexahedron consists of one octahedron as FIG. 8*a* two tetrahedrons as FIG. 4.

Three-axial close-packing pertaining to this invention begins at one point in space, from which tetrahedrons and octahedrons can be attached to each other in the direction of the six vectors. It applies to the construction of linear and areal trusses, not intended as part of any claims of this patent, for roofs, walls and floors of various shapes. Surface areas of areal trusses may have many shapes. In their triangular surface form, however, they are used as sectional building blocks for all icosahedral spherical structures of this invention. The building blocks are called "truss components".

Six-axial close-packing is stellar-dodecahedral, which is intrinsic to the regular pentagonal dodecahedron. It has six axes intersecting at one point in space, which can also be considered as twelve vectors radiating outward from one central point. Close-packing of tetrahedrons and octahedrons occurs, when tetrahedrons and octahedrons are grouped in five or multiples of five in pentagon form around the twelve vectors in alternating succession, octahedrons onto tetrahedrons and tetrahedrons onto octahedrons. The vector lines (0 to point 36-n, FIG. 30) radiate outward from the central point "O", through the center points of the twelve pentagon faces of a pentagonal dodecahedron. Six-axial close-packing can clearly be recognized in the structural truss development of spherical structures related to the pentagonal dodecahedron.

Ten-axial close-packing allows the construction of spherical structures based on the regular icosahedron. Ten axes are intersecting at one point in space being the geometric center of an iscosahedron. This configuration must be visualized as twenty lines radiating outward in complete symmetry from the central point "O", through the centers of the twenty planar equilateral triangle faces of the icosahedron. The lines are vectors, in the outward directions of which ten-axial close-packing of tetrahedral and octahedral elements takes place.

My truss system in both, areal and icosahedral form has many uses, especially in outer space, where the basic tetrahedral and octahedral building elements could be employed for the construction of planar structures, such as platforms or extensive reflective areas and also for spherical-icosahedral space enclosures of many sizes, from small satelites to gigantic stations. On earth, my truss system is also very useful for dome-like structures, such as IMAX movie theatres, homes, arctic dwellings and shelters of many kinds, for storage containers, playground equipment such as climbers or supports for slides etc., for educational building sets and for the construction of artistic geometric sculptures. The fact, that only one type of isosceles triangle, in its plurality as sheet, panel or strut-arrangement is required for the construction of all of the above applications, would greatly simplify the process of manufacturing and construction, in comparison to present available processes.

BRIEF DESCRIPTIONS OF THE DRAWINGS

FIG. 7 is part of the net of an octahedron.

FIG. 8 is a plan view of an octahedron with three side elevations.

FIG. 9 is a perspective view of an octahedron.

FIG. 10 is a perspective view of three octahedrons attached to one central tetrahedron.

FIG. 11 is a perspective view of two octahedrons attached to each other along their edge lines 35.

FIG. 14 is a perspective view of two octahedrons attached to each other isosceles triangle face to isosceles triangle face.

FIG. 15 is a perspective view of an octahedron attached to an icosahedral nucleus, equilateral triangle face of the octahedron to an equilateral triangle face of an icosahedral nucleus.

FIG. **16*a*** is a perspective view of a tetrahedral rosette.

FIG. 17 is a perspective view of an octahedral rosette arrangement as FIG. 16, as seen from the inside of a truss layer.

FIG. 18 is plan view of a first-layer truss showing ten octahedrons.

FIG. 19 is a plan view of a first-layer truss component consisting of one octahedron and three tetrahedrons.

FIG. 20 is a perspective view of the truss component of FIG. 19.

FIG. 21 is a perspective view of the truss component of FIG. 19.

FIG. 22 is a perspective view of a first-layer truss.

Figure 23:
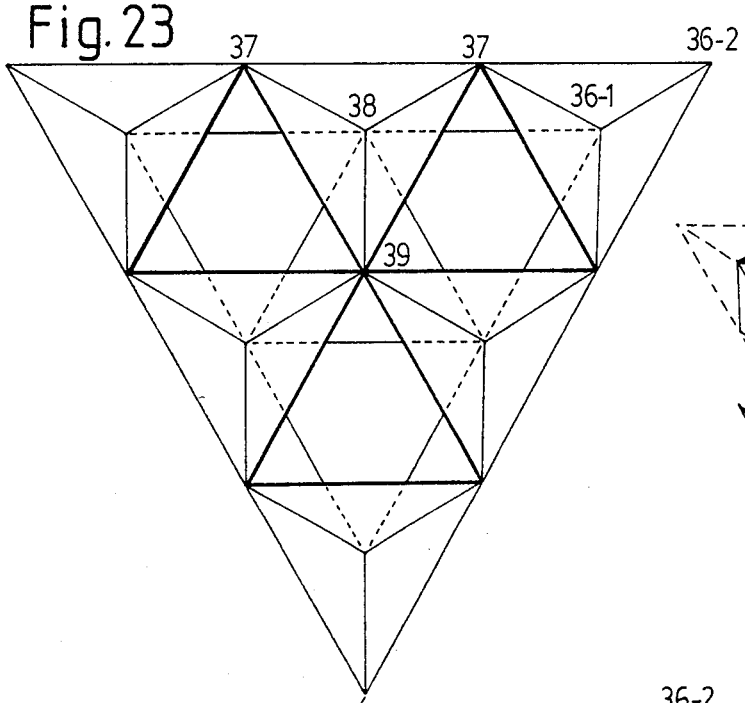

FIG. 23 is a plan view of a second-layer truss component.

Figure 24:
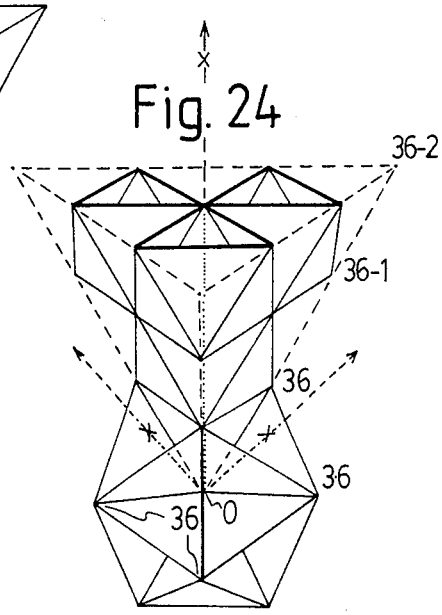

FIG. 24 is a perspective view of second-layer truss component being attached to a first-layer truss component, being attached to an icosahedral nucleus.

Figure 25:
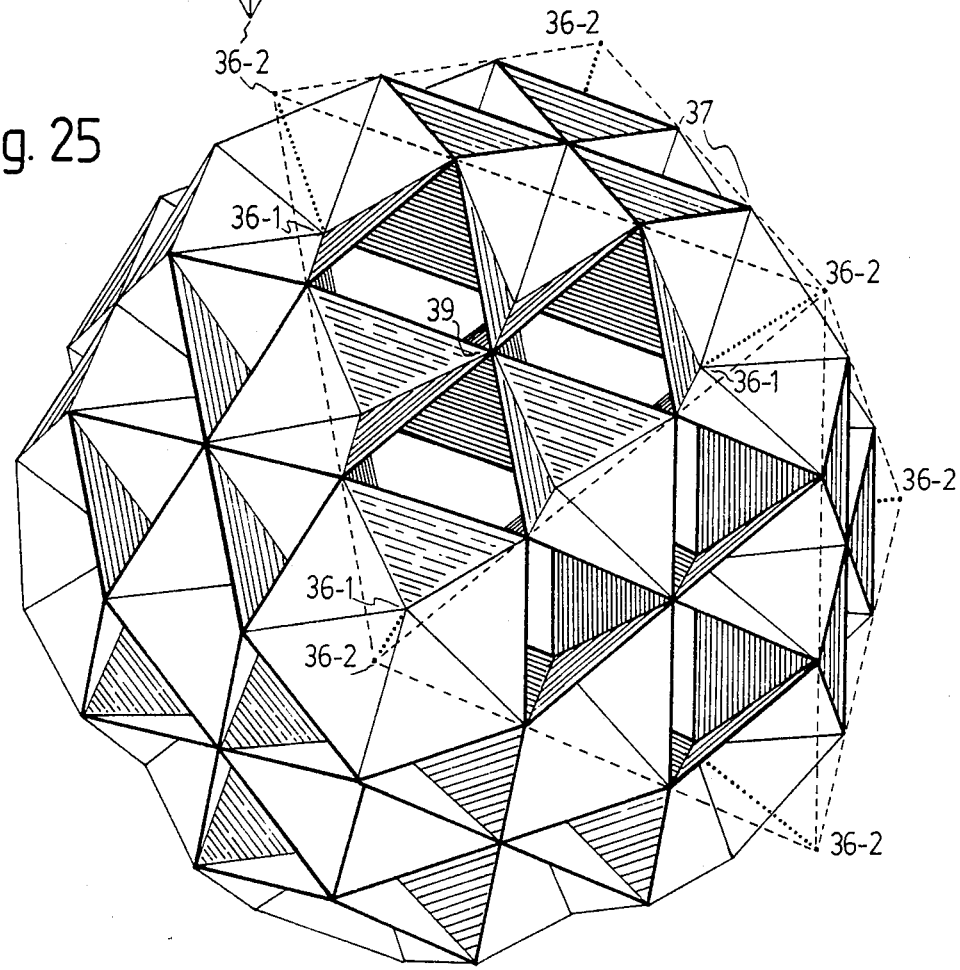

FIG. 25 is a perspective view of a second-layer truss.

Figure 26:
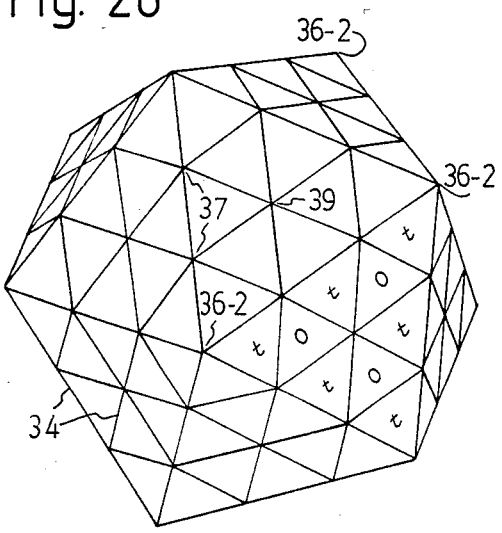

FIG. 26 is a perspective view of an second-layer surface grid of equilateral triangles.

Figure 27:
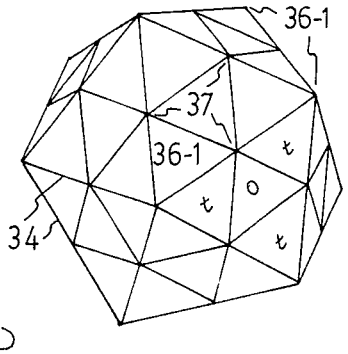

FIG. 27 is a perspective view as FIG. 26 of a first-layer truss.

Figure 28:
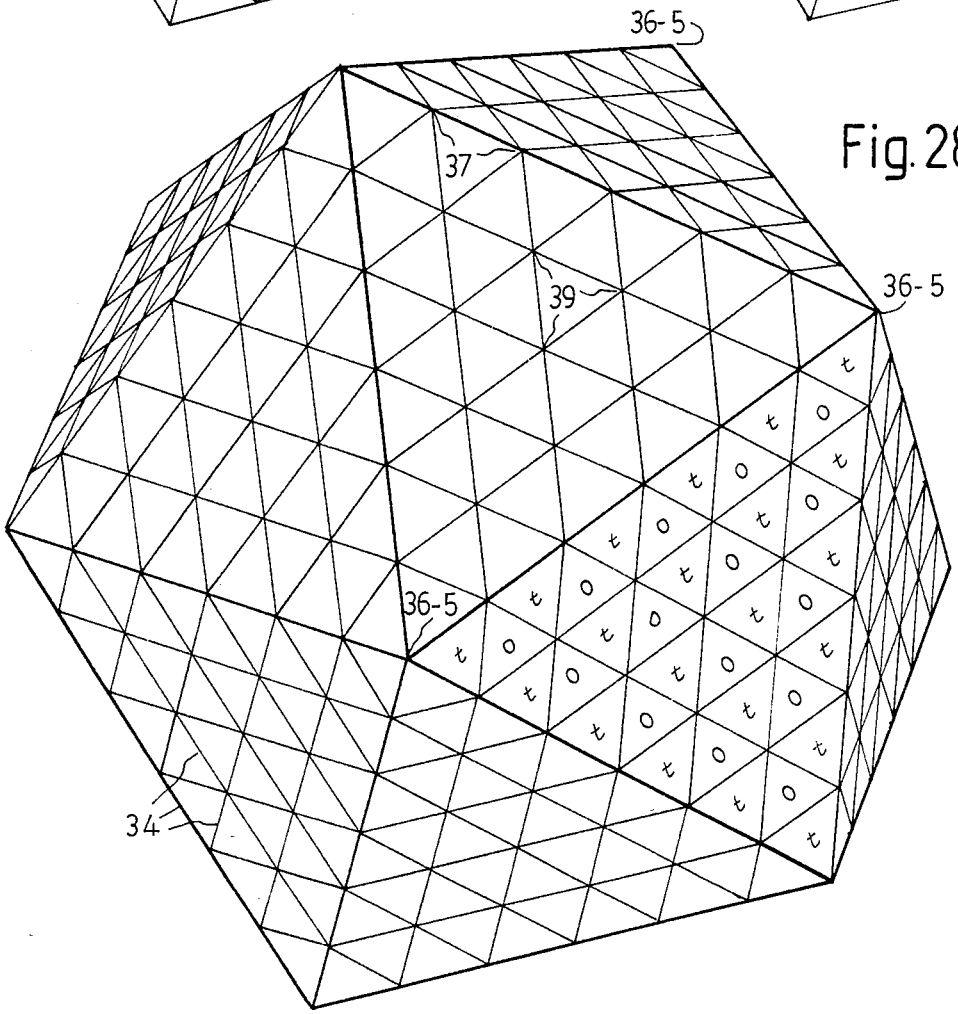

FIG. 28 is a perspective view as FIG. 26 of a fifth-layer truss.

Figure 29:
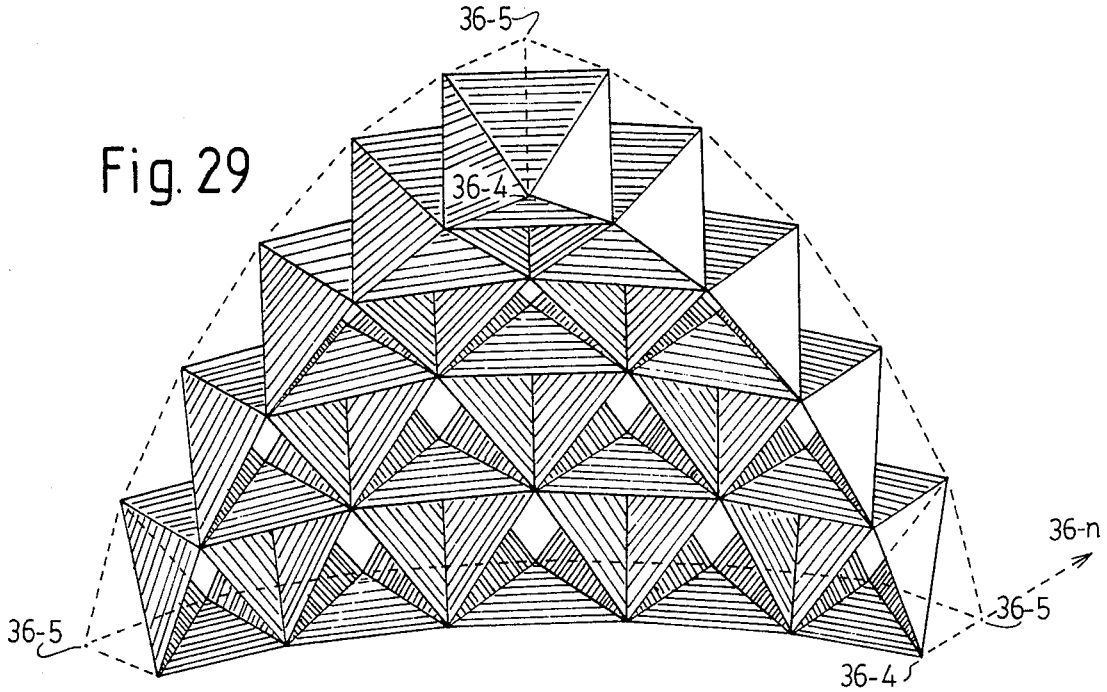

FIG. 29 is a perspective view of a fifth-layer truss component geodesically distorted.

Figure 30:
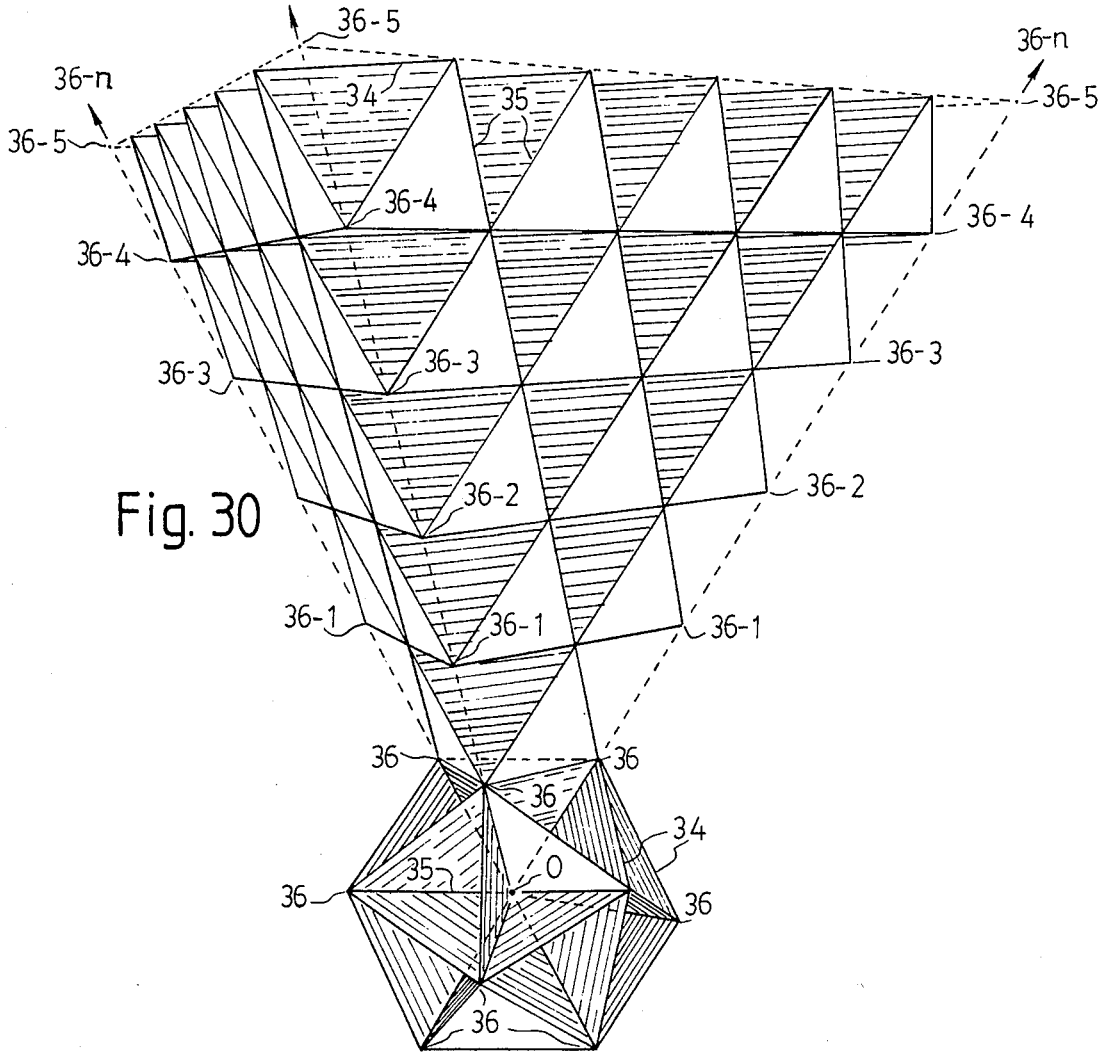

FIG. 30 is a perspective view of an icosahedral nucleus attached with one of its surface triangles to the first five truss components of the first five shell truss layers.

FIG. 31 is a perspective view of a edge-row of a seventh-layer geodesically distorted truss.

FIG. 32 is a plan view of the isosceles triangle sides of the truss components of the first seven truss layers and of one tetrahedron of the central nucleus, with the seventh truss layer also shown geodesically distorted.

Figure 33:
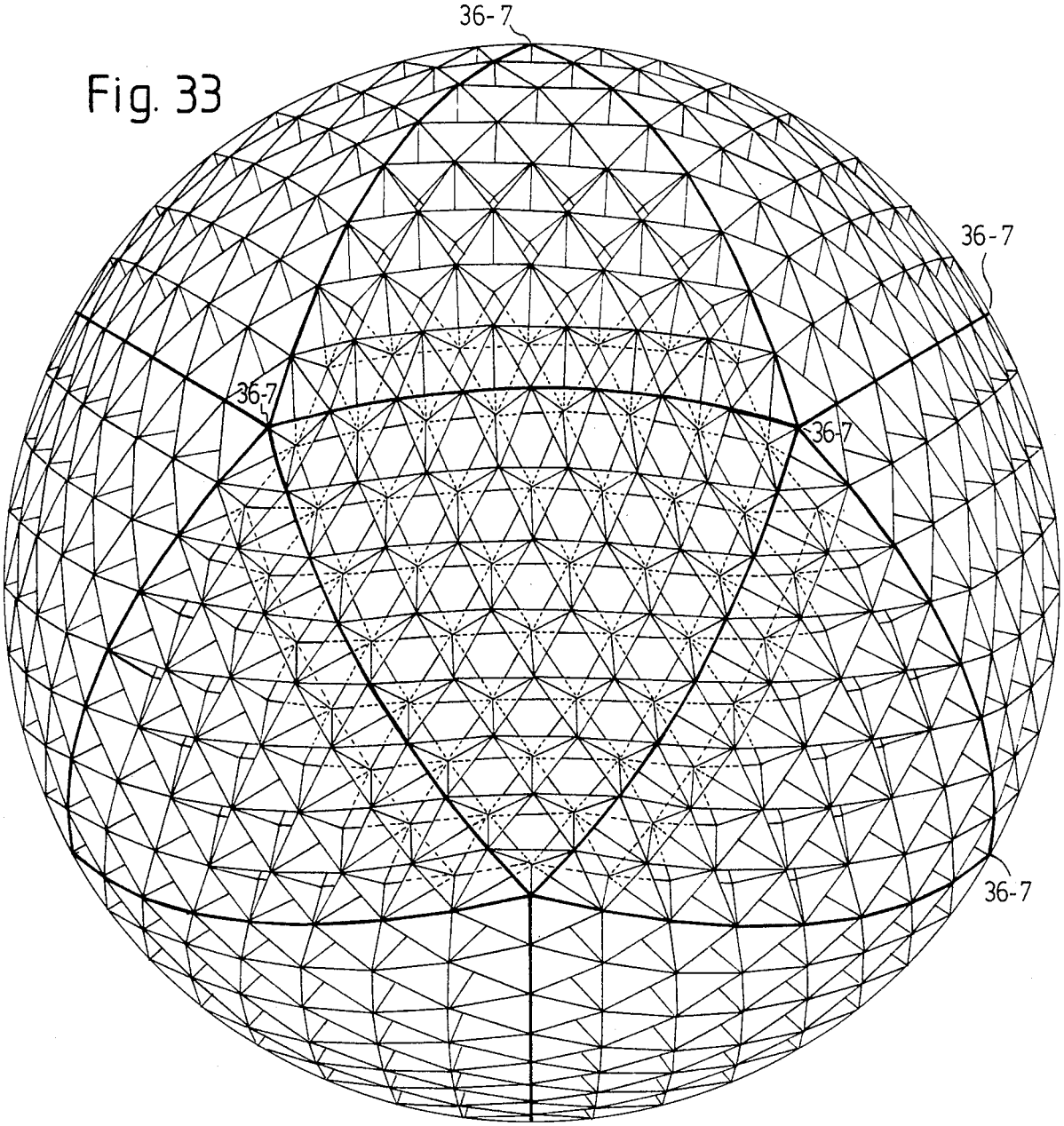

FIG. 33 is a plan view of a geodesic seventh-layer truss.

DEFINITION OF TERMS

Framework: The inter-connected strut or sheet assembly as a whole, for icosahedral and geodesic structures, and structures based on rectangular roof, floor and wall construction, so as to describe the whole rather than parts of the whole.

Frustum: The part of a solid, such as a cone or a pyramid, left, by cutting off the top portion by a plane; or a truncated solid being part of a tetrahedral pyramid of this invention.

Icosahedron: A geometric figure having twenty identical faces, each being an equilateral triangle.

Tetrahedron: A four-sided figure having three sides in the shape of an isosceles triangle and one side in the shape of an equilateral triangle.

Octahedron: An eight-sided figure having six sides in the shape of an isosceles triange and two sides in the shape of an equilateral triangle.

Spherical: A figure approximating the shape of a sphere, such as a regular icosahedron.

Super-structure: An icosahedral-spherical or icosahedral-geodisic truss system, consisting of a sequentially ordered infinite set of ever-increasing space-filling truss shell layers.

Triangular unit: An isosceles triangle as FIG. 1, either in strut or in sheet form.

Truss component: An assembly of octahedral and/or tetreahedral truss elements, either in strut or in sheet form.

Truss layer: an icosahedral-spherical or part-spherical truss, whose structural parts are truss components.

DESCRIPTION OF THE PREFERRED EMBODIMENTS

All continuous icosahedral-spherical truss layer systems, of the type described of the present invention, are ruled by physical, mathematical and geometric conditions which are explained, together with detailed description of the drawings as follows:

Any such system is represented by a plurality of structural strut members of two different lengths, with a ratio of 0.95105652 to 1. The shorter strut is identical to line 35, and the longer strut is identical to line 34 of FIG. 1. The struts are interconnected end to end by hub or ball connectors or by other suitable means.

Figure 1:
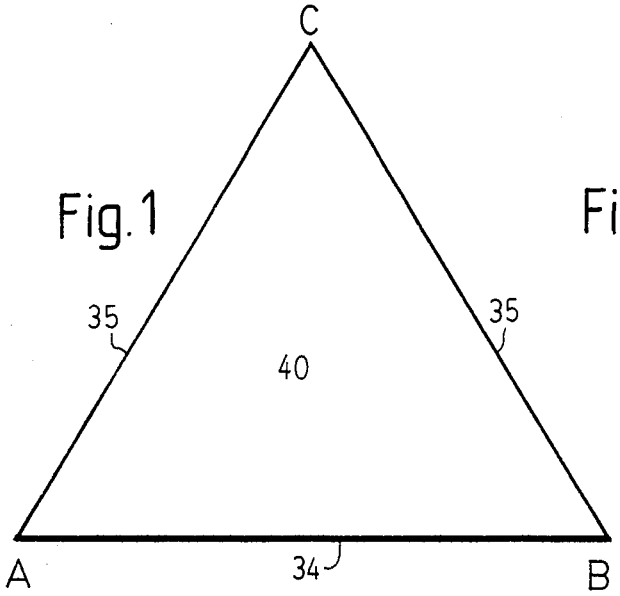
FIG. 1 is the isosceles triangle employed as basic structural unit.

Any such system is represented by a plurality of an isosceles triangle, designated as 40, of FIG. 1. This triangle retains its specific uniform size throughout all the elements, components and truss layer shells of a system. Its vertex angle "C" is 63.4349488 degrees, and its two angles at the base line, at the vertices "A" and "B" are equal, and are 58.2825256 degrees each. The lines AC and BC of FIG. 1 are of equal length and designated 35. The line AB, designated 34, is longer than the lines AC and BC. A length of 1.000000 for line 34, requires a length of 0.95105652 for line 35. The lines 35 are always "inside" of a truss, and employed either as bracing struts and compression members or as two of the edges of triangular sheets. The lines 35 are the legs of the isosceles triangle. Line 34 is the base line of the isosceles triangle. The isosceles triangle, in its plurality, is assembled into tetrahedrons and octahedrons, and in its state of assembly, its base line always abuts an equilateral triangle. Equilateral lateral triangles are always created by three base lines 34, and are always located on the inner and outer surfaces of a truss layer.

Figure 2:
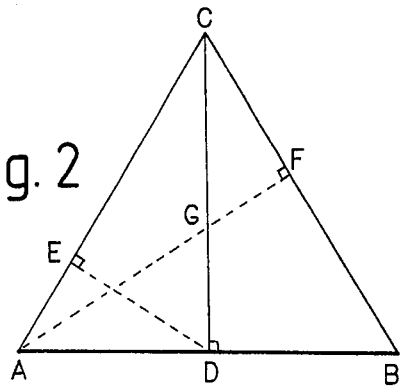
FIG. 2 is the isosceles triangle showing lines of the golden ratio.

FIG. 2 shows an isosceles triangle 40, as FIG. 1. Lines have been drawn from its vertices across the triangle face to the opposite sides, where the lines intersect the sides at right angles. The isosceles triangle is a "golden" or "divine" triangle, because of the presence of the "golden ratio" on its face, between various lines. The golden ratio exists between the following pairs of lines: AD to bisector DC, AE to ED, DE to EC, BD to DC, BF to FA and GF to FC. The golden ratio is a condition between two lines, of which the smaller line has a ratio to the larger line, which is equal to the ratio of the larger line to the sum of the two lines. It can be expressed as a ratio of 0.618034 to 1, which is equal to a ratio of 1 to 1.618034.

Figure 3:
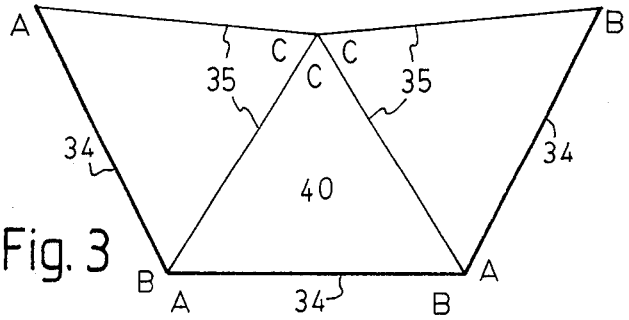
FIG. 3 is part of the net of a tetrahedron.
Figure 4:
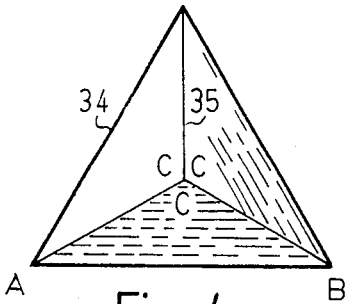
FIG. 4 is a plan view of a tetrahedron.

Any such system is represented by a plurality of two building elements: a tetrahedron as FIG. 4 and an octahedron as FIG. 8. FIG. 3 shows part of the net of a tetrahedron, consisting of three isosceles triangles 40, attached to each other leg to leg. A forth triangle, to complete the net, but not included, is an equilateral triangle. This equilateral triangle is created by the three base lines 34 of the three isosceles triangles. It is the equilateral base area on which the tetrahedron of FIG. 4 is resting. All "C" points of the three isosceles triangles meet at one point, and in its assembled state, this point becomes the top pyramidal vertex point of the tetrahedron.

Figure 5:
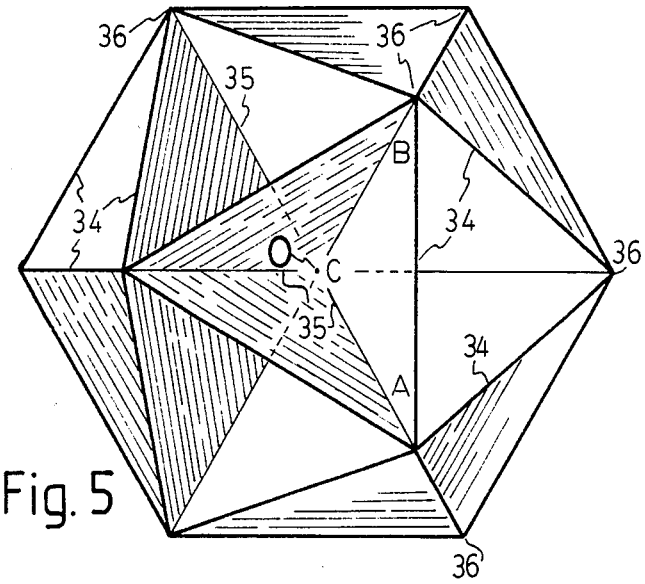
FIG. 5 is an icosahedral nucleus shape made of twenty tetrahedrons.
Figure 6:
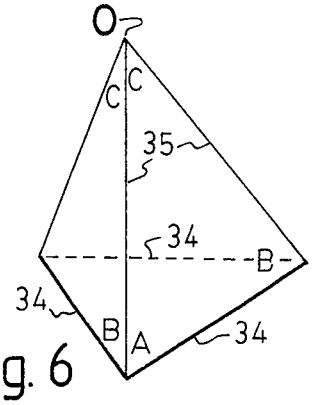
FIG. 6 is a perspective view of a tetrahedron.

Any such system is represented by a nucleus as FIG. 5, and by a sequentially ordered infinite set of ever-increasing icosahedral-spherical shell truss layers, which are created by truss components. The truss component for the nucleus is a tetrahedron as of FIG. 4. FIG. 5 is a plan view of a nucleus. It has the shape of an icosahedron, whose outer surface consists of twenty congruent equilateral triangles. Its outer edges are the base lines 34 of thirty isosceles triangles 40, as FIG. 1. The thirty isosceles triangles are pointed inward, and their "C" points meet at the geometric center of the icosahedron. In this configuration, the thirty isosceles triangles from twenty identical tetrahedrons, as the tetrahedron of FIG. 4. The icosahedral shape, consisting of twenty tetrahedral pyramids, is the central truss nucleus to the multi-faceted close-packing and space-filling feature of tetrahedrons and octahedrons and to icosahedral-spherical consecutive layers of truss shells, described in this invention. The center of the nucleus is point "O". All points, designated 36, are the vertices of the outer surface of the icosahedral nucleus truss.

FIG. 7 shows part of the net of an octahedron, which is made from six isosceles triangles 40 as the triangle of FIG. 1. An octahedron is an eight-sided solid. The two missing polygons are created when the six isosceles triangles are assembled by the attachment of point "H" to point "H" and point "I" to point "I". The two sets of base lines 34, which are H-J-L-H and I-K-M-I appear as two equilateral triangles in FIG. 8*a*. FIG. 8*a* is the octahedron in its assembled state. It rests on one of its equilateral triangles, and a second equilateral triangle is the top triangle HJLH. Both are "open" triangles. The six isosceles tilting wall triangles of the octahedron are drawn as sheets, and they are attached to each other leg to leg, with each top vertex of every isosceles triangle being attached to and wedged between two base angles of two adjacent isosceles triangles. FIG. 8*b*, 8*c* and 8*d* are side elevation views of FIG. 8*a*, and FIG. 9 provides a perspective view of FIG. 8*a*.

The volume of one octahedral element is equal to four times the volume of a tetrahedral element. If line 34 of a specific truss system has a length of 1.00000, the volume of a tetrahedron of that system is 0.10908475 and the volume of an octahedron of that system is 0.436339.

Figure 12:
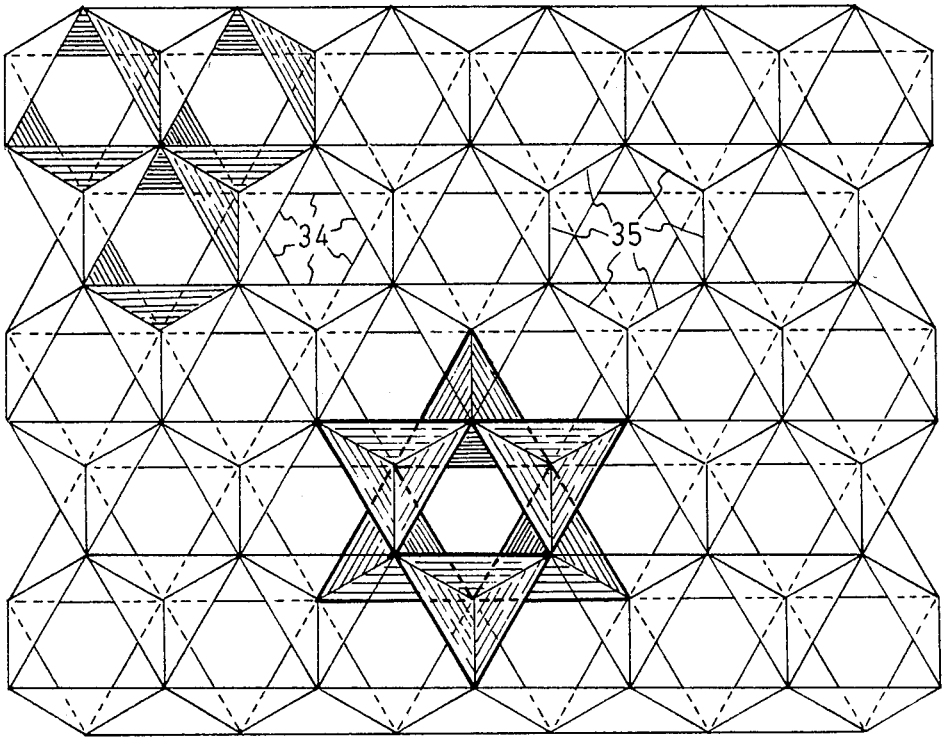
FIG. 12 is a plan view of an areal tetrahedral-octahedral truss.

Within a truss component, tetrahedrons and octahedrons are always connected to each other by the attachment of an isosceles triangle face 40 of a tetrahedron to the isosceles triangle face 40 of an octahedron. FIG. 10 shows a perspective view of three octahedrons, which are attached to a central tetrahedron, of which the tetrahedron points downward. However, this arrangement can also be visualized as three octahedrons being attached along their sloping edge lines 35, thus creating a central tetrahedral space. Such attachment can also be observed of FIG. 12, which is a plan view of an areal tetrahedral-octahedral truss with an outline being generally rectangular. The truss consists of twenty-eight octahedrons, all situated on a common plane with each octahedron resting on one of its equilateral triangles, and all edge-attached along the sloping lines 35. Regardless of the fact, that only octahedrons were used to build this truss, tetrahedral spaces can be seen in the assembly, and by examining the attachment of the tetrahedral spaces, it is evident, that tetrahedrons alone are also able to produce the truss system of this invention. Tetrahedrons are also edge-attached along their 35 lines, in a pattern which creates octahedral spaces within truss components of a truss layer. The highlighted star-like outline at the lower center of FIG. 12 shows location and orientation of six tetrahedrons which are edge-attached to each other along their lines 35. The assembly creates one central octahedral space.

Figure 13:
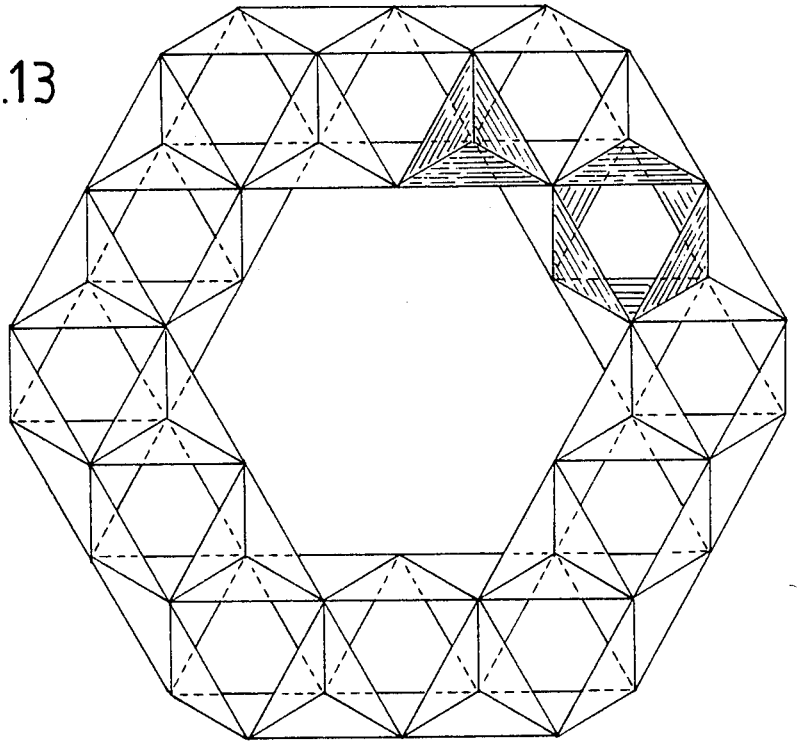
FIG. 13 is a plan view of a linear truss in hexagonal format.

FIG. 13 is a plan view of octahedrons, edge-attached as FIG. 10. The layout is hexagonal. Seven central octahedrons are omitted, indicating empty space in an enclosure of hexagonal-cylindrical shape, which can be built by placing octahedrons onto the octahedrons shown, by connecting two octahedral elements, equilateral triangle face of one octahedron to one equilateral triangle face of another octahedral element.

While face to face attachment of two isosceles triangles of unequal truss elements, i.e. octahedrons to tetrahedrons, produces planar areal trusses; similar face to face attachment of equal truss elements, tetrahedron to tetrahedron or octahedron to octahedron, produces truss rosettes of five-fold symmetry and angular trusses with dihedral angles of 138.18968 degrees. This dihedral angle is identical to the dihedral angle of an icosahedron, as FIG. 5. FIG. 14 is a perspective view of two octahedrons, which are attached with one isosceles triangle face 40 of one octahedron to an isosceles triangle face of a second octahedron. The heavy-lined highlighted triangles are equilateral. Their corner points, marked 36, are identical in coordinate position to the coordinate position of the points 36 of the icosahedral nucleus. This means, that the two adjacent equilateral triangles of FIG. 14 can be attached in close-packing fashion to any two adjacent equilateral triangles of a nucleus such as FIG. 15.

Figure 16A:
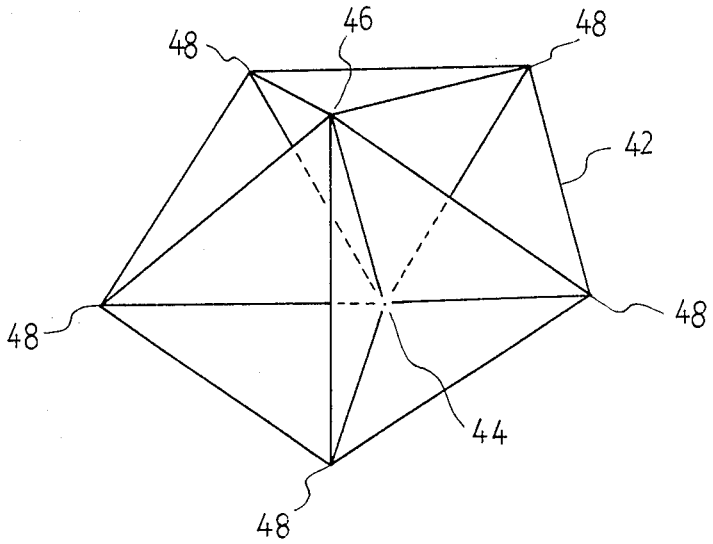
FIG. 16 is a perspective view of an octahedral rosette arrangement consisting of five octahedrons, as seen from the outside.

FIG. 16 is a perspective view of five octahedrons as FIG. 8*a*, having the type of attachment as FIG. 14, showing a rosette arrangement from the outside of a truss layer. FIG. 16*a* illustrates five tetrahedrons attached to one another to form a pentagonally shaped rosette 42. An isosceles face of each tetrahedron is joined to an isosceles face of an adjacent tetrahedron and an edge of each joined face is joined to a corresponding edge of each other joined face with the opposite ends of the joined edges forming an inner apex 44 and an outer apex 46. The faces on the inner side of the tetrahedral rosette are all isosceles triangles while the faces in its outer side are equilateral triangles. The tetrahedral rosette 42 fits into the pentagonial recess defined in the upper surface of the octohedral rosette in a close packing fashion. The inner apex 44 of the tetrahedral rosette 42 faces into the recess. Every individual completed truss layer of the icosahedral-spherical design, being part of the system described in this invention, carries twelve pentagonal rosettes, octahedrons on its inner surface and tetrahedrons on its outer surface, with the centers of the rosettes being located at the vectors 0 to 36-n.

FIG. 17 is a perspective view of five octahedrons as FIG. 16. The rosette assembly is the same, but it is a view from the inside. Its five central triangles are equilateral triangles, which can be attached in close-packing fashion to a tetrahedral rosettes 42 All points 36 are identical in coordinate position to the points 46 and 48 of the pentagonal rosette 11; and FIG. 18 is the plan view of part of a first-layer of an icosahedral-spherical truss. The circular arrangement shows ten octahedrons, which are attached to each other, isosceles triangle 40 of one octahedron to an isosceles triangle of another octahedron. The rosette of five octahedrons of FIG. 16 can be attached to the top pentagonal opening. The corner points 36 of the pentagon fit the points 36 of the rosette. The inner node points of this first-layer icosahedral-spherical truss are identical in coordinate position to the outer node points 36 of the nucleus, FIG. 5.

Any such system is represented by a plurality of truss components of which twenty of equal size are used for each icosahedral-spherical truss layer. Every truss component is created by tetrahedral elements as FIG. 4, in combination with octahedral elements, as FIG. 8*a*.

Truss components of any truss layer of the continuous icosahedral-spherical system have inner and outer surfaces. These surfaces have the shape of equilateral triangles which are assemblages of the equilateral triangles of the individual tetrahedral and octahedral elements of which the truss components are created.

The number of octahedral building elements for truss components of consecutive truss layers increases in the following mathematical progression:

| Layer No. | Number of Octahedrons per Truss Component |
|---|---|
| 1 = 1 = | 1 |
| 2 = 1 + 2 = | 3 |
| 3 = 1 + 2 + 3 = | 6 |
| 4 = 1 + 2 + 3 + 4 = | 10 |
| 5 = 1 + 2 + 3 + 4 + 5 = | 15 |
| 6 = 1 + 2 + 3 + 4 + 5 + 6 = | 21 |
| 7 = 1 + 2 + 3 + 4 + 5 + 6 + 7 = | 28 |
| 8 = 1 + 2 + 3 + 4 + 5 + 6 + 7 + 8 = | 36 |
| 9 = 1 + 2 + 3 + 4 + 5 + 6 + 7 + 8 + 9 = | 45 |
| 10 = 1 + 2 + 3 + 4 + 5 + 6 + 7 + 8 + 9 + 10 = | 55 |
| 11 = 1 + 2 + 3 + 4 + 5 + 6 + 7 + 8 + 9 + 10 + 11 = | 66 |
| 12 = 1 + 2 + 3 + 4 + 5 + 6 + 7 + 8 + 9 + 10 + 11 + 12 = | 78 |
| 13 = 1 + 2 + 3 + 4 + 5 + 6 + 7 + 8 + 9 + 10 + 11 + 12 + 13 = | 91 |
| 14 = 1 + 2 + 3 + 4 + 5 + 6 + 7 + 8 + 9 + 10 + 11 + 12 + 13 + 14 = | 105 |
| 15 = 1 + 2 + 3 + 4 + 5 + 6 + 7 + 8 + 9 + 10 + 11 + 12 + 13 + 14 + 15 etc. = | 120 |

The number of tetreahedral elements per truss component is always equal to the number of octahedral elements times two, plus one. Two examples: (1) A first-layer truss component has one octahedron as per table above; $(1\times2)+1=3$. A first-layer truss component has three tetrahedral elements.

(2) A seventh-layer truss component has twenty-eight octahedrons; $(28\times2)+1=57$. It has fifty-seven tetrahedral elements.

FIG. 19 depicts a plan view of a truss component for a first-layer spherical truss. It consists of one octahedron and three tetrahedrons. Twenty of such truss components are needed to construct one complete icosahedral-spherical truss layer. FIG. 20 is a perspective view of the truss component of FIG. 19. FIG. 21 is also a perspective view of the triangular truss component, with its isosceles triangles 40 shown as sheets, and its equilateral triangles drawn as open spaces. Shading is applied to the visible portions of the inward leaning isosceles triangles of a central octahedral building element.

FIG. 22 is a perspective view of a fully completed first-layer icosahedral-spherical truss shell. The space inside of this shell is equal to the outer dimensions of the icosahedral nucleus of the system. The lines 36 to 36-1 are exensions of the lines 0 to 36 of FIG. 15. Both are part of the vector lines related to six-axial close-packing of octahedrons and tetrahedrons as described in this invention. The numbers added to points 36, such as 1, 2, 3, 4, written as −1, −2, −3, −4 or −n (n=any number), indicate the number of layers there are from the outer node points of the central nucleus to point 36-n of a specific truss layer. Truss layers are numbered from one to infinity. Layer number one is the truss layer closest to the icosahedral nucleus.

FIG. 23 is a plan view of a truss component for second-layer icosahedral-spherical truss. It has three octahedrons and seven tetrahedrons. $(3\times2)+1=7$. Twenty such truss components are required to construct the icosahedral-spherical truss layer. This drawing shows node point locations of 36-1, 36-2, 37, 38 and 39. 36-1 is the inner corner point of this second layer truss component, while on a first-layer truss component (FIG. 19) it is the outer corner point. It means, that the size of an outer surface of a first-layer truss component is identical to the inner surface of a second-layer truss component, and that both can be attached to each other, as depicted of FIG. 24. This rule applies to any two adjacent truss components at any layer-level of the system.

Points 37 are outer edge node points. Points 38 are inner edge node points, and point 39 is a surface node point, not being located at a corner or anywhere on the edge of a truss component. The attachment of FIG. 23 to FIG. 19 places the inner edge node points 38 of the second-layer truss component onto the outer edge node points 37 of the first-layer truss component. The outer peripheral dimension of one side of the triangular truss component of FIG. 23, is longer, by the length of the base line 34 of the isosceles triangle of the system, than the inner peripheral dimension of one side of the truss component. This rule applies to all truss components of the system.

FIG. 24 is a perspective view of a nucleus having one of its equilateral surface triangles covered with a first-layer truss component, which is covered with a second-layer truss component. All tetrahedral elements located at corners and edges are outlined with dotted lines. Ever-increasing truss components can be placed simultaneously, upon all the equilateral surface triangles of the icosahedral nucleus to infinity. Vectors, in the direction of which ten-axial close-packing takes place, are twenty lines radiating from point "O" of the central icosahedral nucleus, through the centers of its twenty equilateral surface triangles, and through all the centers of subsequent truss components of all consecutive truss layers of the system.

FIG. 25 is a perspective view of a second-layer icosahedral truss shell. It is incomplete and shows only octahedrons, so as not to confuse the viewer. Dotted lines, however, indicate where some of the tetrahedrons and points 36-2 are located. The vector lines 0 to 36-n are extended to points 36-2, when rosettes of tetrahedrons are placed onto the existing rosettes of octahedrons.

FIG. 26 shows a perspective view of a completed surface grid of an icosahedral-spherical second-layer truss shell. One of its truss components, being divided into nine equilateral triangles, shows the locations of tetrahedrons marked "t" and of octahedrons marked "O". All short surface lines are the base lines 34 of the isosceles triangles, as the isosceles triangle of FIG. 1.

FIG. 27 is a perspective view of the surface grid of a completed icosahedral-spherical first-layer truss shell.

FIG. 28 is a perspective view of the surface grid of a completed icosahedral-spherical fifth-layer truss shell.

FIG. 29 is a perspective view of a fifth-layer truss component, which shows a geodesically curved version, of which all inner node points have their radii identical to the radii from point "O" to points 36-4, and all outer node points have their radii identical to the radii from point "O" to points 36-5. Tetrahedrons located along the outer rims and corners of the triangular components are defined by dotted lines.

For multiple truss layers of the continuous superstructure, layers, belonging to the same tetrahedral pyramid of the nucleus, are attached face to face, to each other by connecting the equilateral (surface) triangles of octahedrons of a truss component to the equilateral (surface) triangles of tetrahedrons of an adjacent truss component.

FIG. 30 is a perspective view of a tetrahedral pyramid consisting of the first five truss components of the first five truss layers of the system, together with its nuclear tetrahedron terminating at point "O" of the icosahedral nucleus. The lines 0 to 36-5 are vectors, around which tetrahedrons and octahedrons form rosettes of five-fold symmetry. These lines determine the directions in which six-axial close-packing occurs, when rosettes of tetrahedrons are placed onto rosettes of octahedrons, and vice versa.

All shell layers of a specific system are always of equal thickness. The thickness of a shell layer is always equal to: (a) the height of a tetrahedron resting on its equilateral triangle, (b) the shortest distance between the two equilateral triangles of an octahedron, with both, tetrahedron and octahedron belonging to the same system. If the length of line 34 is 1.00000, the shell layer thickness is 0.75576123.

Any icosahedral-spherical truss layer of a truss system described in this invention is represented by a set of inner and outer node points. All outer node points of a specific truss layer share their coordinate locations with the coordinate locations of the inner node points of the next larger truss layer of the system.

Attachment between layers is achieved, either by placing the equilateral triangles of one truss layer onto the equilateral triangles of an adjacent truss layer; or by the fastening of the struts 34 of an outer surface of one truss layer to the inner struts 34 of the adjacent next larger truss layer; or by the node point connectors being shared by two adjacent layers.

Attachment within one truss layer between octahedral and tetrahedral truss elements and between truss components is achieved by fastening isosceles triangles 40 of one truss element or component face to face to the isosceles triangle 40 of an adjacent truss element or component; or by fastening the leg struts 35 of one truss element or component to the leg struts 35 of an adjacent truss element or component; or by the sharing of the inner and outer node points located along the peripheral edges of adjacent truss components.

Sets of ever-increasing truss components, as shown in FIG. 30, being connected face to face to each other with their inner and outer equilateral truss surfaces, being of equal thickness and each having the shape of a frustum, belong to one specific tetrahedral pyramid of the icosahedral nucleus.

Every individual truss component of FIG. 30 belongs to a set of twenty truss components of equal size, which are capable of being assembled into an icosahedral-sperical space-enclosure, as FIG. 25.

FIG. 31 is a perspective view of a geodesically distorted edge-row of octahedral and tetrahedral elements of a seventh-layer truss component. This edge-row connects two pentagonal surface rosettes of tetrahedrons, spanning from point 36-7 on the left to point 36-7 on the right hand side. This drawing shows the entire arrangement in strut form and not as sheets. The configuration appears again as a plan view in FIG. 32 as the curved seventh-layer truss.

FIG. 32 depicts a plan view of an isosceles triangle having the same proportion as the isosceles triangle 40 of FIG. 1. It represents a planar triangular area between two vectors 0 to 36-7. Each layer shows octahedrons as a side elevation view as FIG. 8*b*.

FIG. 33 is a top view of a geodesically distorted seventh-layer icosahedral-spherical truss shell. Its triangular truss components are are identical. The tetrahedral and octahedral elements are of various dimentions and different angular values. The former isosceles triangles are no longer uniform, however, the advantages of a geodesic truss are greater strength and an increase of approximately sixty-five percent in volume of the inner space of the structure. The mathematical transformation from an icosahedral-spherical to a geodesic-sperical shape requires calculations for the placing of node points on inner and outer truss components as uniformly spaced as possible from each other, and placing all node points equidistantly from point "O" of the system. In this process, the radii 0 to 36-n of the inner and outer corner vertex points of the icosahedral-spherical truss components remain unchanged in the transformation. The vectors 0 to 36-n must stay in their fixed locations as determined by the icosahedral nucleus.

The terms used in the text of this invention are deemed to be in a descriptive sense and not in a limiting restrictive way, and equivalents of the features described, which fall within the range of the invention are not intended to be excluded from the invention.

What I claim is:

1. A truss structure comprising at least one octahedral rosette formed from five octahedrons each having a face joined to a face of an adjacent octahedron, the octahedrons being disposed in a ring around a node at which an apex of each of the octahedrons is joined, the octahedral rosette defining a pentagonal recess in its outer side, and associated with each octahedral rosette, a tetrahedral rosette formed from five tetrahedrons each having a face joined to a face of an adjacent tetrahedron, the tetrahedrons being disposed in a pentagonally shaped cluster with an edge of each joined face being joined to a corresponding edge of each other joined face and with opposite ends of the joined edges forming an inner and an outer apex, the tetrahedral rosette being joined to the octahedral rosette with which it is associated and fitting in the pentagonal recess in close packing fashion therein.

2. A truss structure according to claim 1 formed from a plurality of said octahedral rosettes with the node of each octahedral rosette, and the inner and outer apices of the associated tetrahedral rosette, falling on a different radius, each radius passing through a different vertex of an icosahedron.

3. A truss structure according to claim 1 comprising a plurality of said octahedral rosettes joined to form contiguous concentric spheroidal layers with each layer of equal thickness and with the node of each octahedral rosette of a layer coincident with a complementary outer apex of the tetrahedral rosette of a layer disposed immediately inwardly thereof.

4. A truss structure according to claim 1 in which each tetrahedron has three congruent faces each in the shape of an isosceles triangle, two of which are each joined to an adjacent tetrahedron of the cluster, and a base in the form of an equilateral triangle, each base in the cluster being disposed toward the outer apex of the cluster.

5. A truss structure according to claim 1 in which each octahedron has six congruent faces, each in the shape of an isosceles triangle, two of which are each joined to an adjacent octahedron of the at least one octahedral rosette, and two faces each in the form of an equilateral triangle, with one face aligned toward the outer side of the at least one octahedral rosette and one face aligned toward the inner side of the at least one octahedral rosette.

6. A truss structure according to claim 4 in which the ratio of twice the length of the bisector between the two equal sides of each isosceles triangle to the length of the unequal side is the golden ratio.

7. A truss structure according to claim 5 in which the ratio of twice the length of the bisector between the two equal sides of each isosceles triangle to the length of the unequal side is the golden ratio.

* * * * *